US006997630B2

(12) United States Patent
Chi et al.

(10) Patent No.: US 6,997,630 B2
(45) Date of Patent: Feb. 14, 2006

(54) DOCUMENT FEEDER DEVICE WITH A ROLLER ADJUSTMENT DEVICE

(75) Inventors: Hye S. Chi, Raleigh, NC (US); Robert A. Myers, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 16 days.

(21) Appl. No.: 10/843,164

(22) Filed: May 11, 2004

(65) Prior Publication Data

US 2005/0254877 A1 Nov. 17, 2005

(51) Int. Cl.
*B41J 11/14* (2006.01)

(52) U.S. Cl. ..... 400/653; 400/634; 400/636; 400/648; 400/58; 271/109

(58) Field of Classification Search ..... 400/578, 400/55, 56, 59, 634, 636, 648, 649, 650, 400/653; 101/141, 216, 212; 271/109
See application file for complete search history.

(56) References Cited

U.S. PATENT DOCUMENTS 3,441,188 A 4/1969 May et al.
4,035,044 A 7/1977 Miyazaki
5,527,030 A * 6/1996 Kimura et al. ..... 271/185
5,606,720 A * 2/1997 Verhoest et al. ..... 396/620
5,987,954 A * 11/1999 Hauck et al. ..... 72/248
6,109,180 A * 8/2000 Guaraldi et al. ..... 101/466
6,216,592 B1 * 4/2001 Knauer et al. ..... 101/247
6,227,111 B1 * 5/2001 Dawley et al. ..... 101/218
6,318,257 B1 * 11/2001 Niemiro et al. ..... 101/212
6,357,683 B1 * 3/2002 Patzelt et al. ..... 241/235
6,398,400 B1 6/2002 Nienhaus
6,585,253 B1 * 7/2003 Miki ..... 271/125

* cited by examiner

*Primary Examiner*—Daniel J. Colilla
*Assistant Examiner*—Dave A. Ghatt
(74) *Attorney, Agent, or Firm*—Sawyer Law Group LLP

(57) ABSTRACT

A document feeder device is disclosed. The document feeder device includes a frame, a first roller shaft coupled to the frame, and a second roller shaft coupled to the frame. The first shaft is cantilevered. The document feeder device further includes a bearing coupled to the first roller shaft. The bearing has an eccentric shape and the eccentric shape allows the bearing to be rotated such that the position of the first roller shaft stays parallel to a second roller shaft. As a result, rollers attached to the first and second roller shafts are kept aligned so that they reliably feed documents through a printer. The document feeder device decreases production costs by eliminating the need for additional frame hardware and/or more rigid frame hardware.

20 Claims, 10 Drawing Sheets

100

102

100

102

102

102

102

DOCUMENT FEEDER DEVICE WITH A ROLLER ADJUSTMENT DEVICE

RELATED CO-PENDING PATENT APPLICATION

The present invention is related to a co-pending U.S. application Ser. No. 10/633,958, filed on Sep. 04, 2003, and entitled "Document Feeder Device."

FIELD OF THE INVENTION

The present invention relates to document printers and more particularly to a document feeder device with a roller adjustment device that reliably adjusts a roller.

BACKGROUND OF THE INVENTION

Printers are well known and are used to print documents onto loose, single sheets of paper. Such documents can include, for example, preprinted forms that are 8½"×11" or A4 as well as narrower documents such as receipts, checks, etc. For ease of discussion, the terms document and sheet are used interchangeably. A document can be a blank sheet or a pre-printed sheet. Alternatively, a document can be a multi-part or multi-ply form, with or without carbon paper. A sheet is typically of paper but is not limited to paper.

Document feeder devices are typically used to feed sheets through a printer. FIG. 1 is a top-view diagram of a conventional document feeder device 50 of a printer 51. The document feeder device 50 advances a sheet 52 along a paper path in a slot 58. The document feeder device 50 includes a set of rollers 62–68 disposed around a pair of roller shafts 70 and 72. The ends of the roller shafts 70 and 72 are directly connected to and supported by bearings 74, 76, 82, and 84, respectively, which are connected to and supported by frame supports 78, 80, 86, and 88, respectively. The sheet 52 is placed parallel to the shafts 70 and 72 and between the rollers 62–68. The roller shafts 70 and 72 rotate in opposite directions to advance the sheet 52 through the printer 51.

The problem with the conventional document feeder device 50 is that is difficult to provide an adequately rigid and stable mounting surface for the roller shafts 70 and 72. A slight movement of one of the roller shafts 70 and 72 causes a substantial misalignment between the rollers 62 and 66 and/or between the rollers 64 and 68. Unfortunately, there is not a way to bridge a support across the front and main portions 54 and 56 without obstructing the paper path.

One conventional solution to the problem is to make the overall printer frame, including the frame supports 78, 80, 86, and 88 as rigid as possible. Accordingly, it would be necessary to keep a tight tolerance of multiple parts associated with the frame supports 78–88. However, doing so increases the cost of production by requiring additional frame hardware and/or more rigid frame hardware.

Accordingly, what is needed is an improved system and method for keeping the rollers of a printer aligned to more reliably feed documents through the printer. The system and method should be cost effective and easily implemented in existing designs. The present invention addresses such a need.

SUMMARY OF THE INVENTION

A document feeder device is disclosed. The document feeder device comprises a frame, a first roller shaft coupled to the frame, and a second roller shaft coupled to the frame. The first shaft is cantilevered. The document feeder device further includes a bearing coupled to the first roller shaft. The bearing has an eccentric shape and the eccentric shape allows the bearing to be rotated such that the position of the first roller shaft stays parallel to a second roller shaft. As a result, rollers attached to the first and second roller shafts are kept aligned so that they reliably feed documents through a printer. The document feeder device decreases production costs by eliminating the need for additional frame hardware and/or more rigid frame hardware.

DETAILED DESCRIPTION

The present invention relates to document printers, and more particularly to a document feeder device with a roller adjustment device that reliably adjusts a roller. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

A document feeder device is disclosed. The document feeder device comprises a frame, a first roller shaft coupled to the frame, and a second roller shaft coupled to the frame. In a specific embodiment, the first roller shaft is a cantilevered roller shaft. One embodiment of a cantilevered roller shaft is described in a co-pending U.S. application Ser. No. 10/633,958, filed on Aug. 4, 2003, and entitled "Document Feeder Device." Because the cantilevered roller shaft is supported at one end, the other end may be susceptible to sagging. In accordance with the present invention, the document feeder device further includes a bearing coupled to the first roller shaft. The bearing has an eccentric shape and the eccentric shape allows the bearing to be rotated such that the position of the first roller shaft stays parallel to the second roller shaft. As a result, rollers attached to the first and second roller shafts are kept aligned so that they reliably feed documents through a printer. The document feeder device decreases production costs by eliminating the need for additional frame hardware and/or more rigid frame hardware. To more particularly describe the features of the present invention, refer now to the following description in conjunction with the accompanying figures.

Although the present invention disclosed herein is described in the context of a document feeder device utilizing a cantilevered roller shaft, the present invention may apply to other document feeder devices utilizing other types of roller shafts and still remain within the spirit and scope of the present invention.

Figure 1:
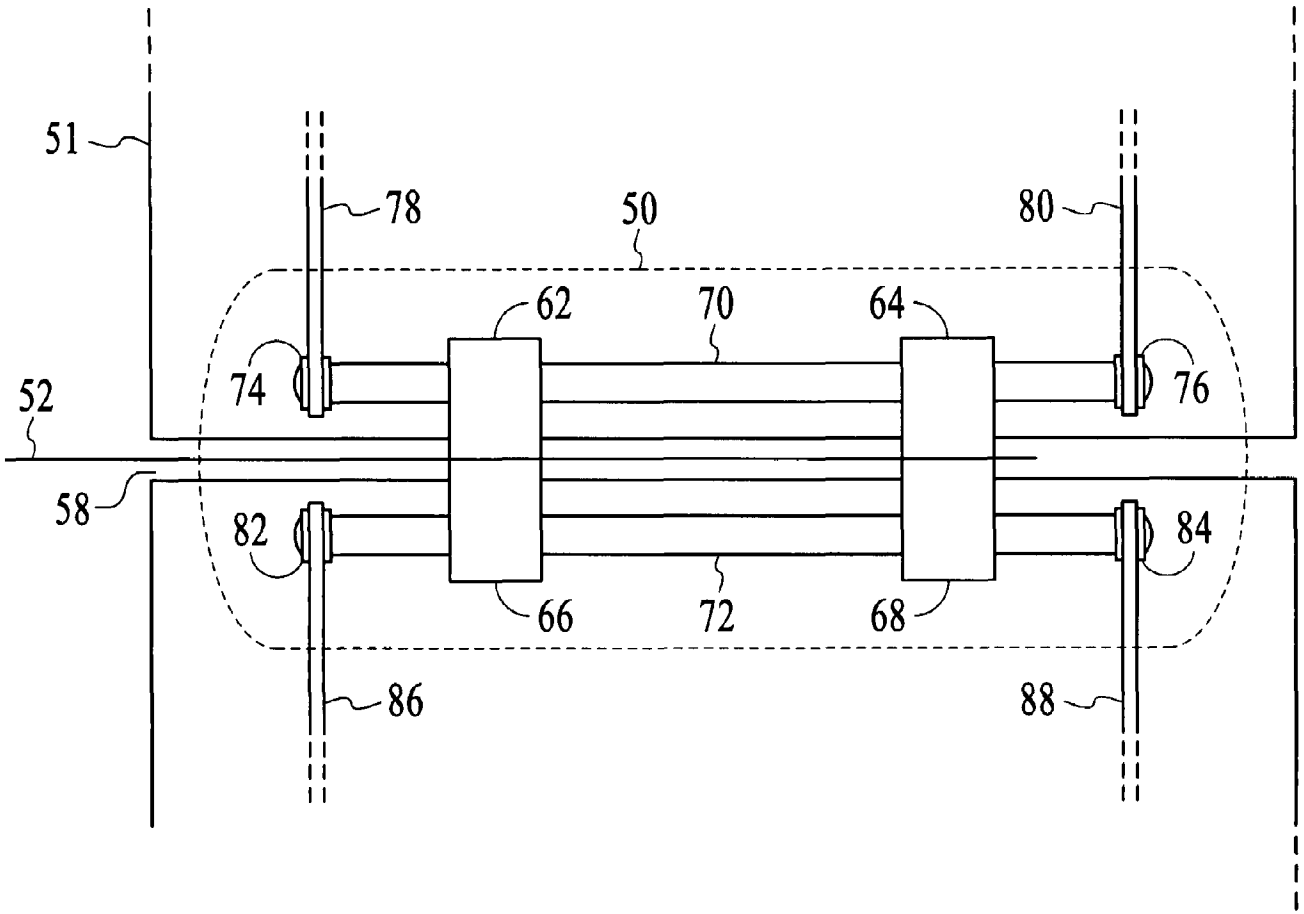
FIG.1 (PRIOR ART)
FIG. 1 is a top-view diagram of a conventional document feeder device of a printer.
Figure 2:
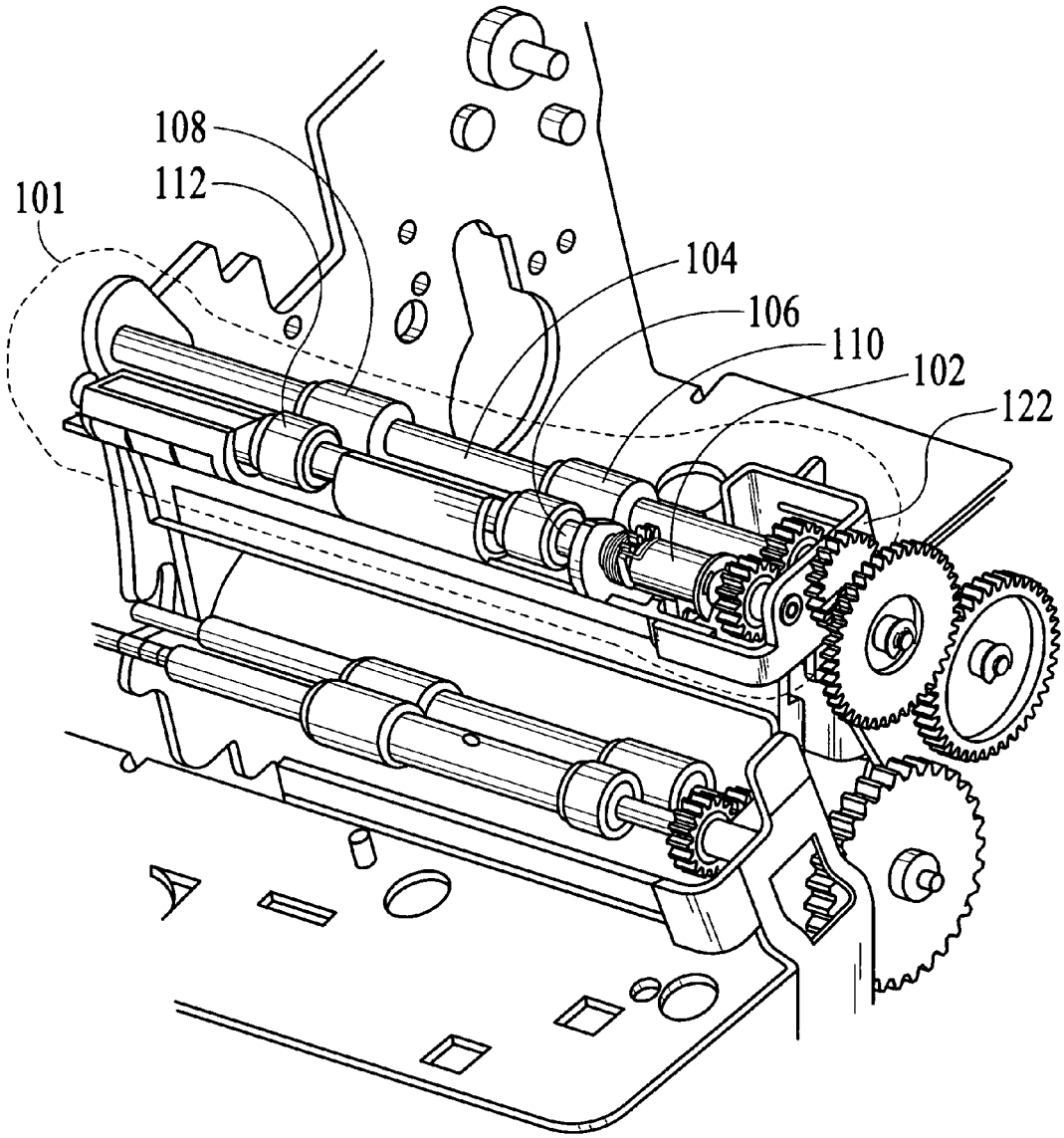
FIG. 2 a perspective-view diagram of a printer with its cover opened, including a document feeder device and a roller adjustment device in accordance with the present invention.

FIG. 2 a perspective-view diagram of a printer 100 with its cover opened, including a document feeder device 101 and a roller adjustment device 102 in accordance with the present invention. The document feeder device 101 comprises a roller shaft 104 and a roller shaft 106. The roller shaft 104 is coupled to rollers 108 and 110 and the roller shaft 106 is coupled to rollers 112 and 114.

A roller adjustment device 102 functions as a bearing and keeps the roller shafts 104 and 106 parallel to each other and provides contact pressure between the roller shafts 104 and 106. This ensures that the rollers 108–114 stay aligned and reliably feed sheets through the printer 100. The roller adjustment device 102 is supported by a frame support 122. In a specific embodiment, the rollers 108 and 110 (and/or the rollers 112 and 114) can be integrated into a single unit such as a gimbaled roller. Gimbaled rollers are known in the art. The use of a gimbaled roller ensures balanced contact and proper alignment between itself and the drive rollers.

In the specific embodiment of FIG. 2, the roller shaft 106 is cantilevered. This allows the document feeder device 101 to be applied to various types of printers including a crabtree printer, where another pair of rollers are used on top of a scanner to pull checks or other documents through. Because the roller shaft 106 is cantilevered, misalignment magnifies parallel variations between the rollers shafts 104 and 106. The roller adjustment device 102 compensates for such variations. Accordingly, the roller adjustment device 102 adjusts the roller shaft 106 to eliminate sagging on the cantilevered end or other misalignment variations.

Alternatively, the roller shaft 104 can be cantilevered or both roller shafts 104 and 106 can be cantilevered. Furthermore, the rollers 108 and 110 function as feed rollers in that they are driven to rotate to feed a sheet through the printer 100. The rollers 112 and 114 function as pressure or press rollers in that they apply pressure against the rollers 108 and 110 to provide adequate friction to the sheet to feed it through the printer 100. Alternatively, the rollers 108 and 110 can function as press rollers and rollers 112 and 114 can function as feed rollers. Additional document feeder devices similar to the one described above can be implemented and the specific number of document feeder devices will depend on the specific application.

Figure 3A:
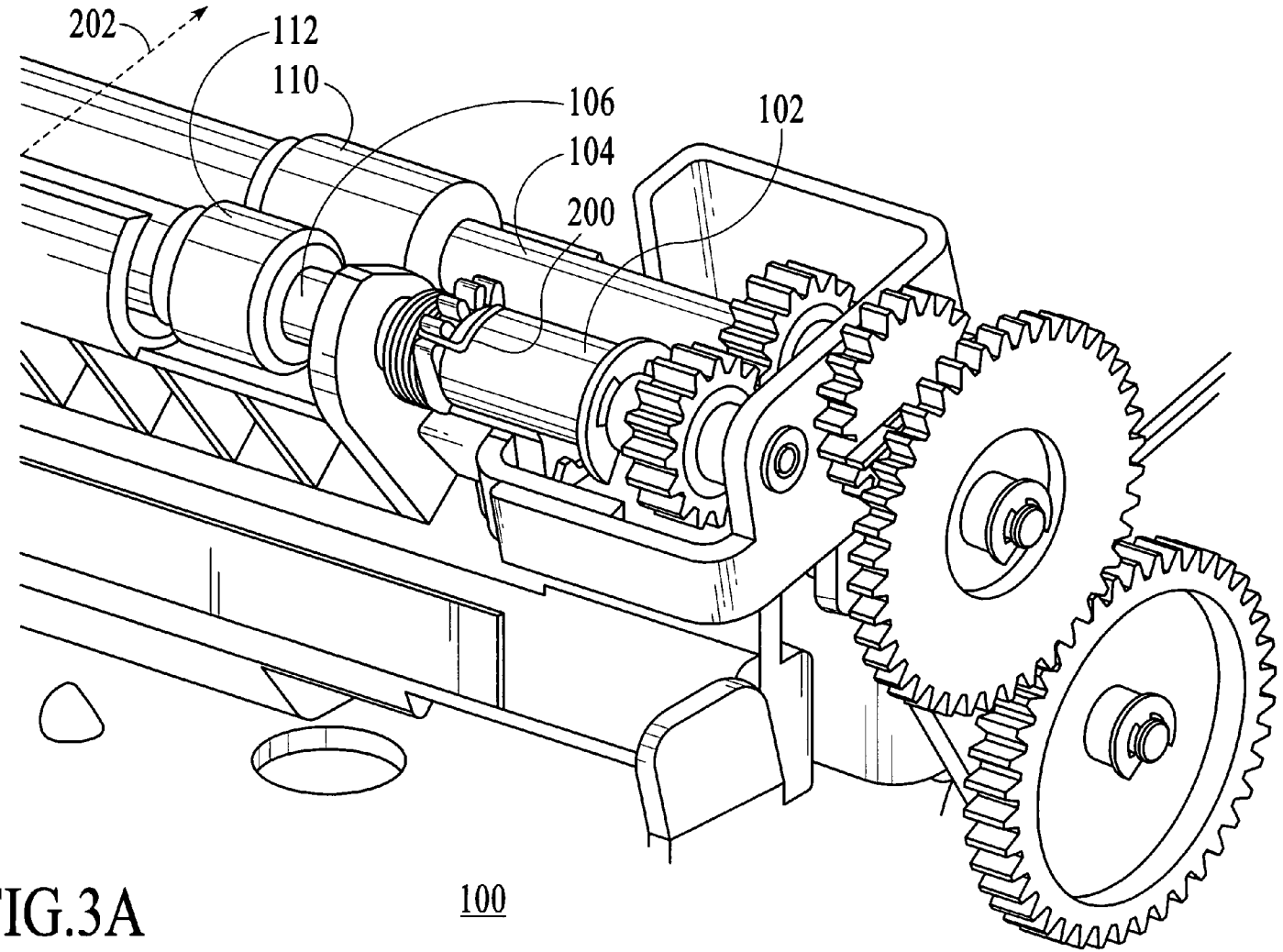
FIG. 3 is a more detailed perspective-view diagram of the roller adjustment device of FIG. 2 in accordance with the present invention.
Figure 3B:
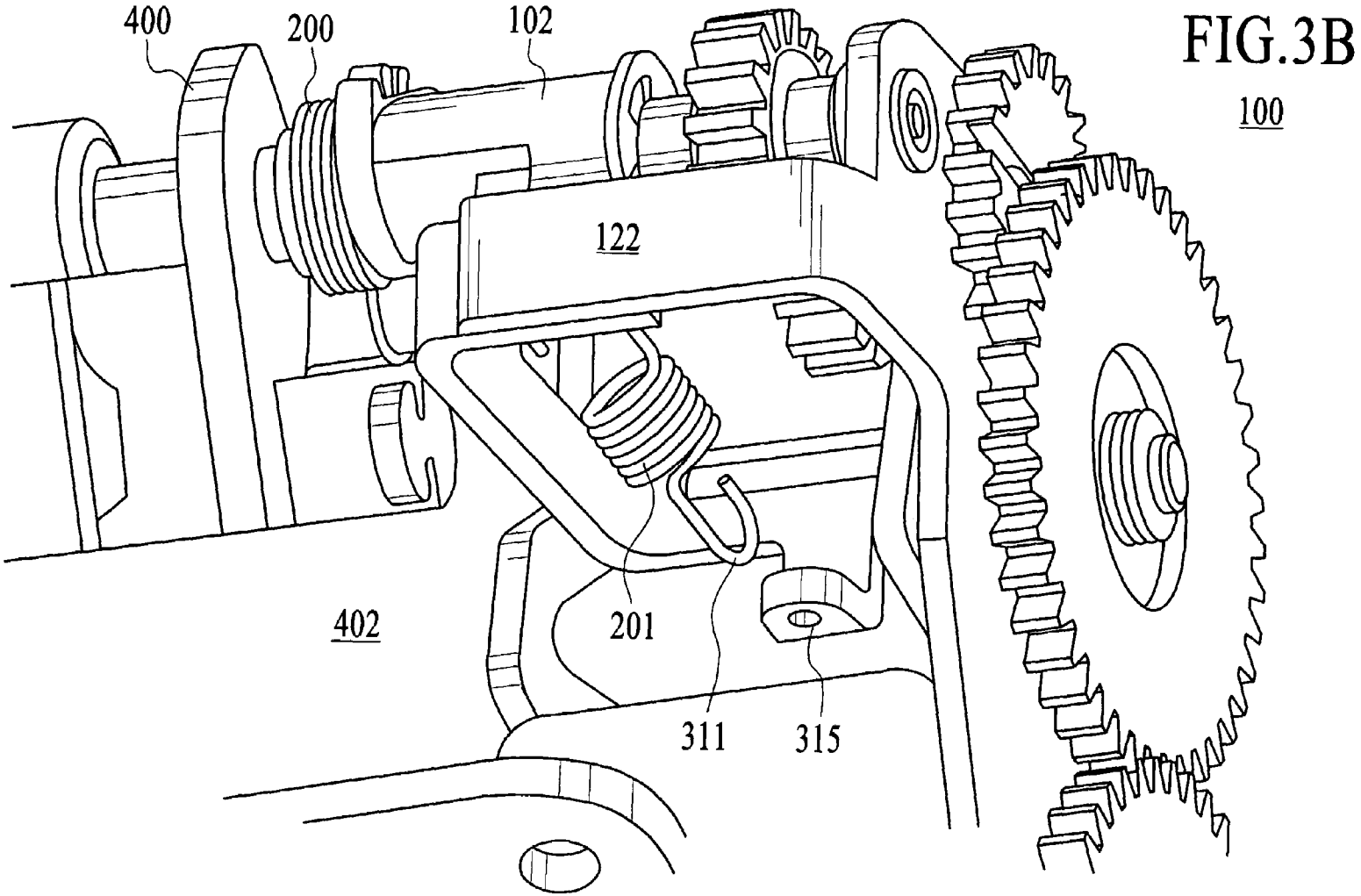

FIG. 3 is a more detailed perspective-view diagram of the roller adjustment device 102 of FIG. 2 in accordance with the present invention. The roller adjustment device 102 attaches to a spring 200. In a specific embodiment, the spring is a torsion spring, which rotates the roller adjustment device 102 and pulls the roller shaft 106 generally against the roller shaft 104 to press the rollers 110 and 114 press against each other. The rollers 112 and 114 (not shown) are also pressed against each other. While the spring 200 pulls the roller shaft 106 generally in the direction of the roller shaft 104, one force component pulls the roller shaft 106 generally in the direction 202.

Figure 4:
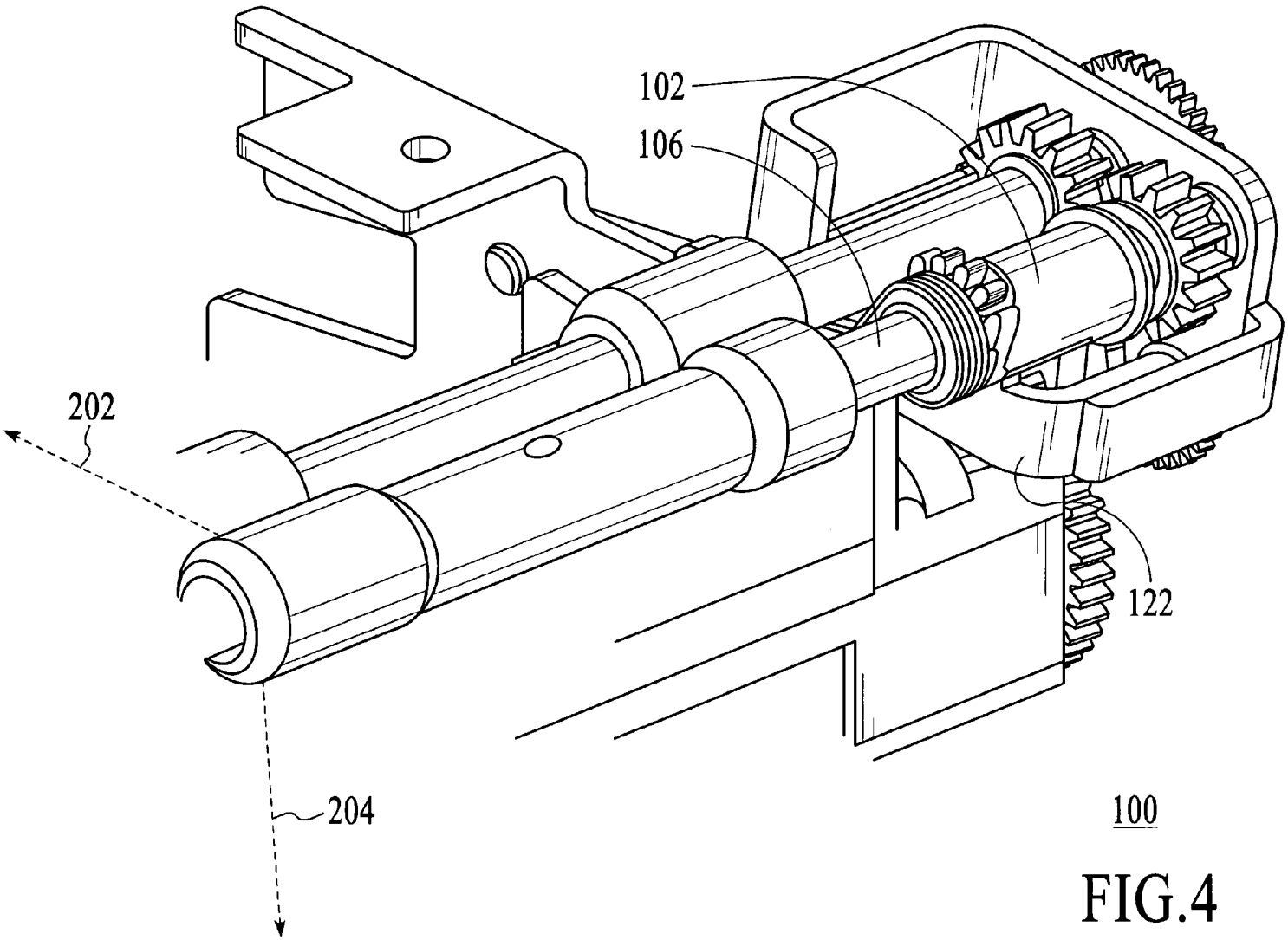
FIG. 4 is another a more detailed perspective-view diagram of the roller adjustment device of FIG. 2 in accordance with the present invention.

FIG. 4 is another a more detailed perspective-view diagram of the roller adjustment device 102 of FIG. 2 in accordance with the present invention. In addition to pulling the roller shaft 106 generally in the direction 202, another force component pulls the roller shaft 106 generally in the direction 204 against the frame support 122. This keeps the roller shaft 106 from sagging.

Figure 5:
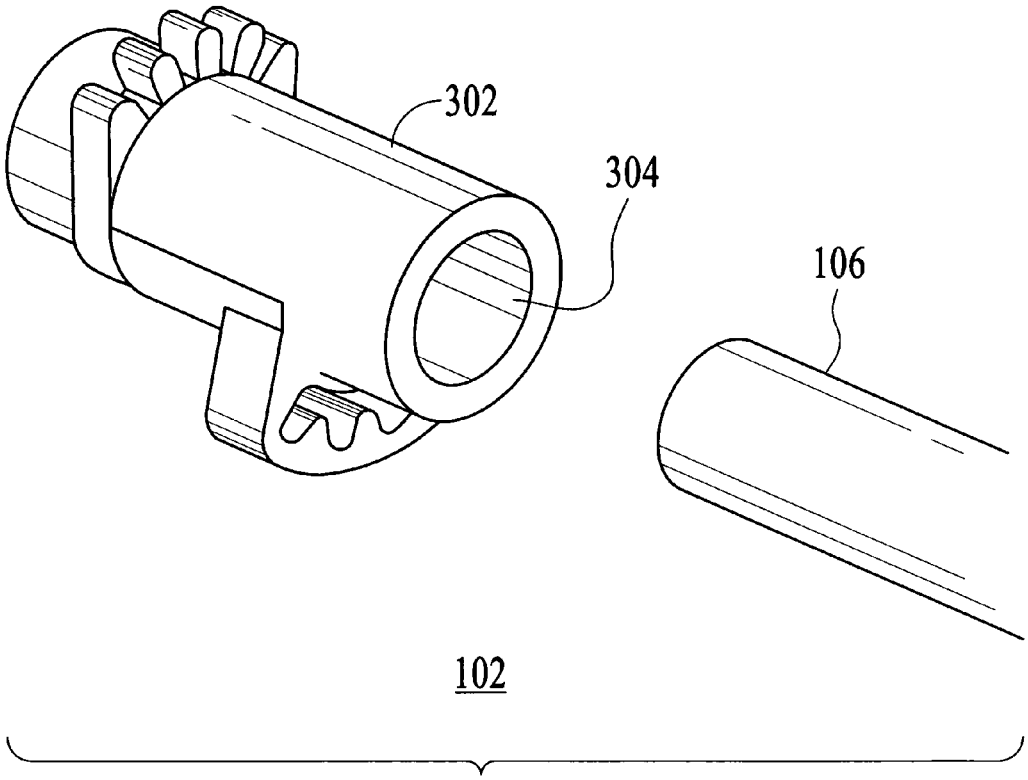
FIG. 5 a perspective-view diagram of the roller adjustment device of FIG. 2 in accordance with the present invention.

FIG. 5 a perspective-view diagram of the roller adjustment device 102 of FIG. 2 in accordance with the present invention. The roller adjustment device 102 functions as a bearing and has a base 302 and a bore 304 for receiving a roller shaft 106. In a specific embodiment, the base 302 is generally cylinder-shaped. Alternatively, the base 302 can have other shapes.

Figure 6:
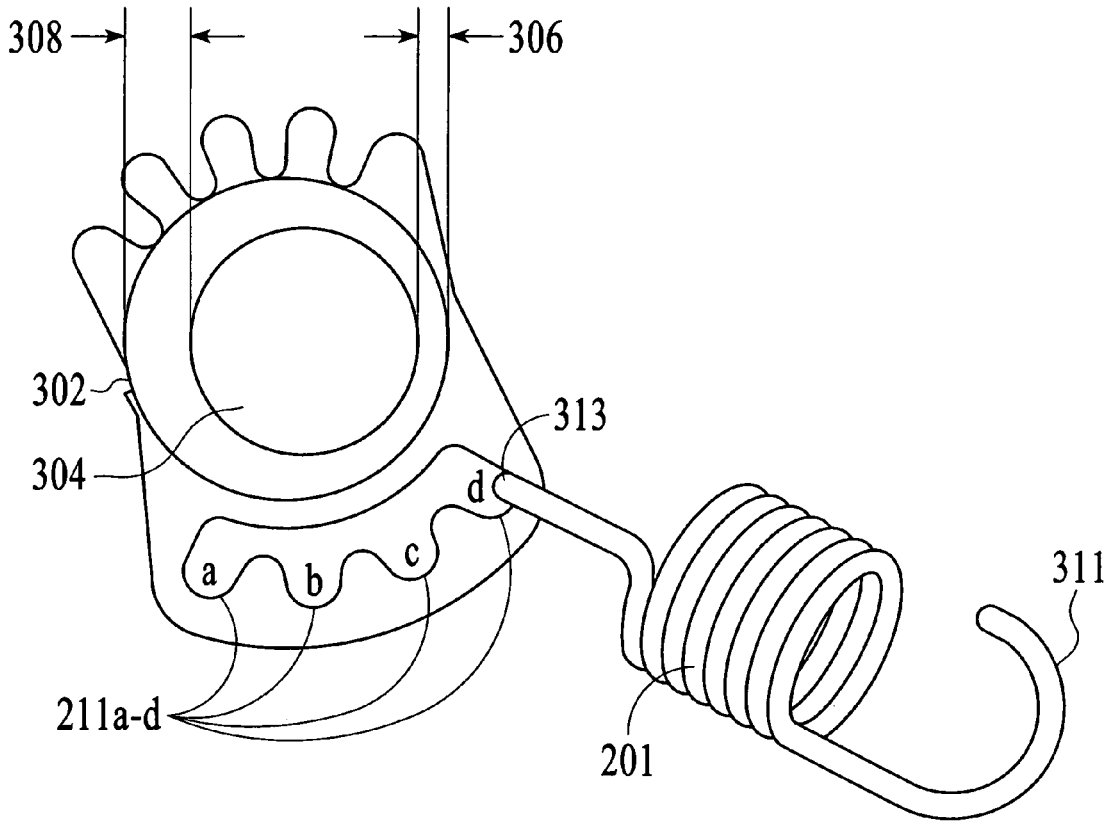
FIG. 6 a back-view diagram of the roller adjustment device of FIG. 2 in accordance with the present invention.

FIG. 6 a back-view diagram of the roller adjustment device 102 of FIG. 2 in accordance with the present invention. The bore 304 is offset from the center of mass of the base 302 such that the diameter of the bore 304 is offset from the diameter of the base 302. This gives the roller adjustment device 102 (i.e., the base 302) an eccentric shape. More specifically, one wall portion 306 of the base 302 is thinner than opposite wall portion 308 of the base 302. Accordingly, the wall gradually thickens from one wall portion 306 to the opposite wall portion 308.

Figure 7A:
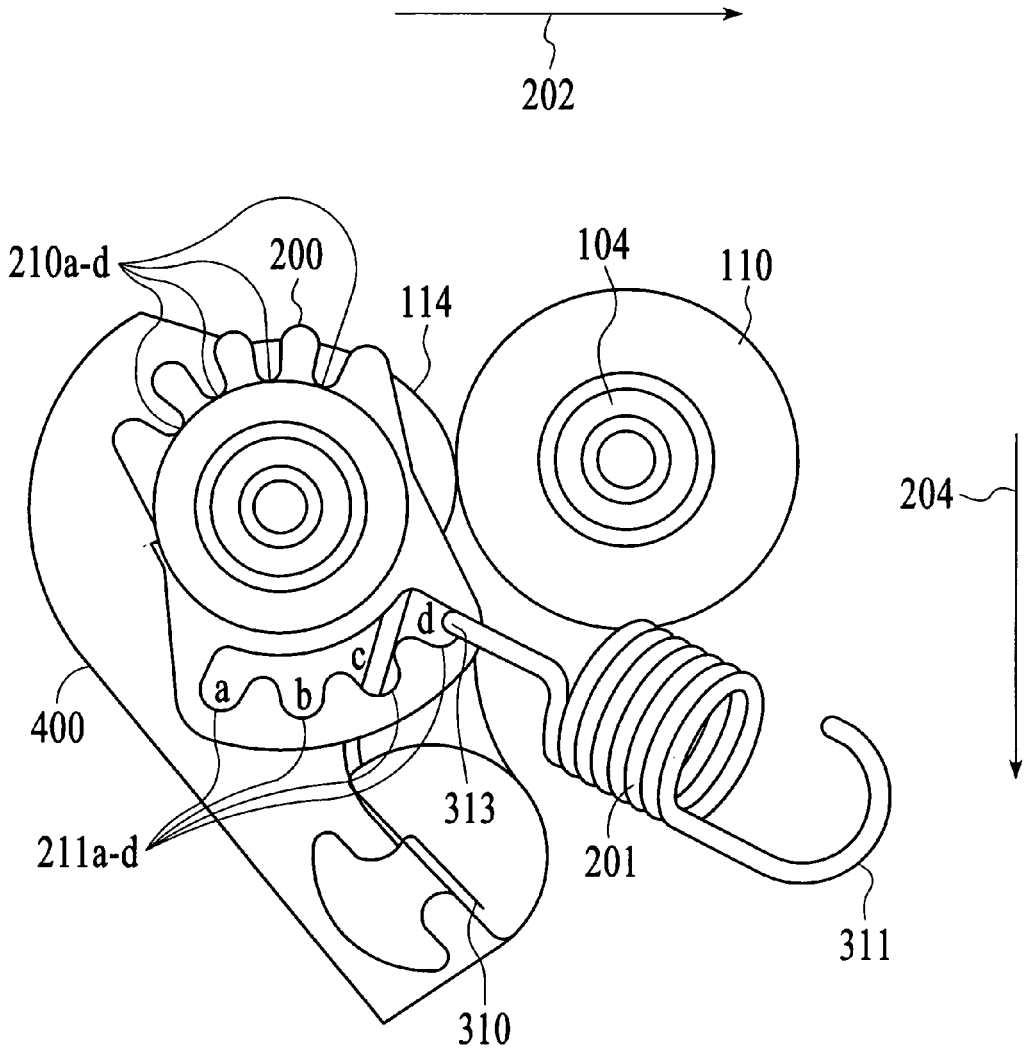
FIG. 7 a front-view diagram of the roller adjustment device of FIG. 2 in accordance with the present invention.
Figure 7B:
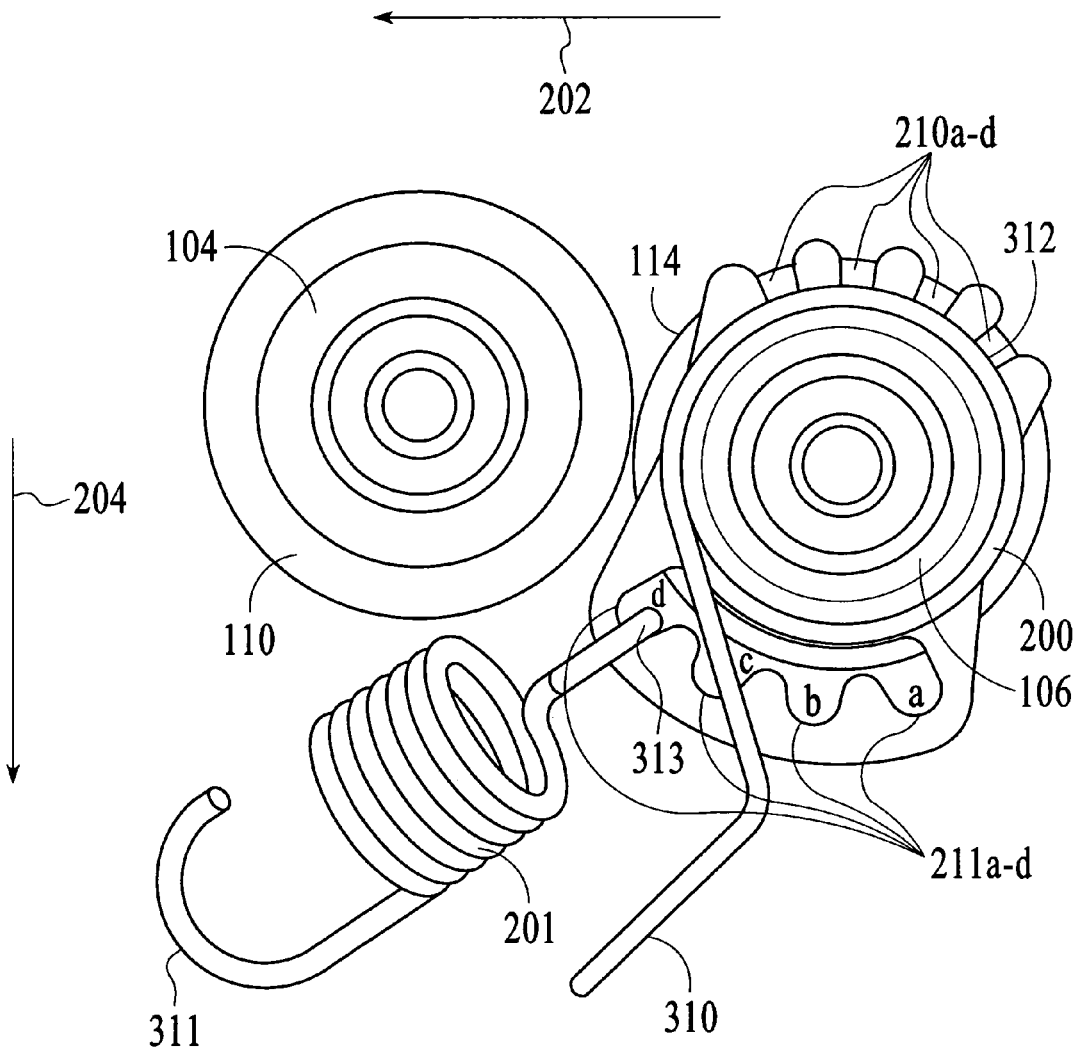

In operation, when the roller adjustment device 102, i.e., the base 302, is rotated, the roller shaft 106 is adjusted relative to the roller shaft 104 (FIG. 7). More specifically, the roller shaft 106 is adjusted up and down, left and right depending on the degree of rotation. This precise calibration of the roller shaft 106 aligns it with the roller shaft 104 so that the two roller shafts 104 and 106 are parallel to each other.

FIG. 7 a front-view diagram of the roller adjustment device 102 of FIG. 2 in accordance with the present invention. The roller adjustment device 102 has finger positions or teeth 210*a*, 210*b*, 210*c*, 210*d*, 210*e*, which are utilized for attaching the spring 200. The teeth 210*a–e* and the spring 200 are utilized to calibrate the degree of rotation of the roller adjustment device 102. The teeth 210*a–e* and the spring also serve a second function, which is to pull the roller shaft 106 generally in the directions 202 and 204 against the roller shaft 104. The teeth 210*a–b* allow the spring 200 to be adjusted to the correct spring force as the roller adjustment device 102 is rotated to obtain good shaft alignment. The roller adjustment device 102 is supported by the frame support 122.

One end 310 of the spring 200 attaches to a part of the printer chassis (not shown) and the other end 312 of the spring 200 attaches to one of the teeth 210*a–e*. The specific tooth to which the end 312 attaches determines a degree of rotation of the roller adjustment device 102 and an amount of pull caused by the spring 200. For example, the specific embodiment of FIG. 6, attaching the end 312 to a tooth on the far left rotates the roller adjustment device 102 in one direction and provides less tension while attaching the end 312 to a tooth on the far right rotates the roller adjustment device 102 in the other direction and provides greater tension. Of course other configurations with regard to the spring are possible and will depend on the specific application. A benefit of the teeth 210*a–e* is that the degree of rotation of the roller adjustment devices 102 and the force of the spring 200 can be tightly controlled to align the roller shafts 104 and 106 and to provide good contact between the rollers 110–114. This provides for optimal feeding for printing or scanning but low drag for reliable feeding.

Figure 8:
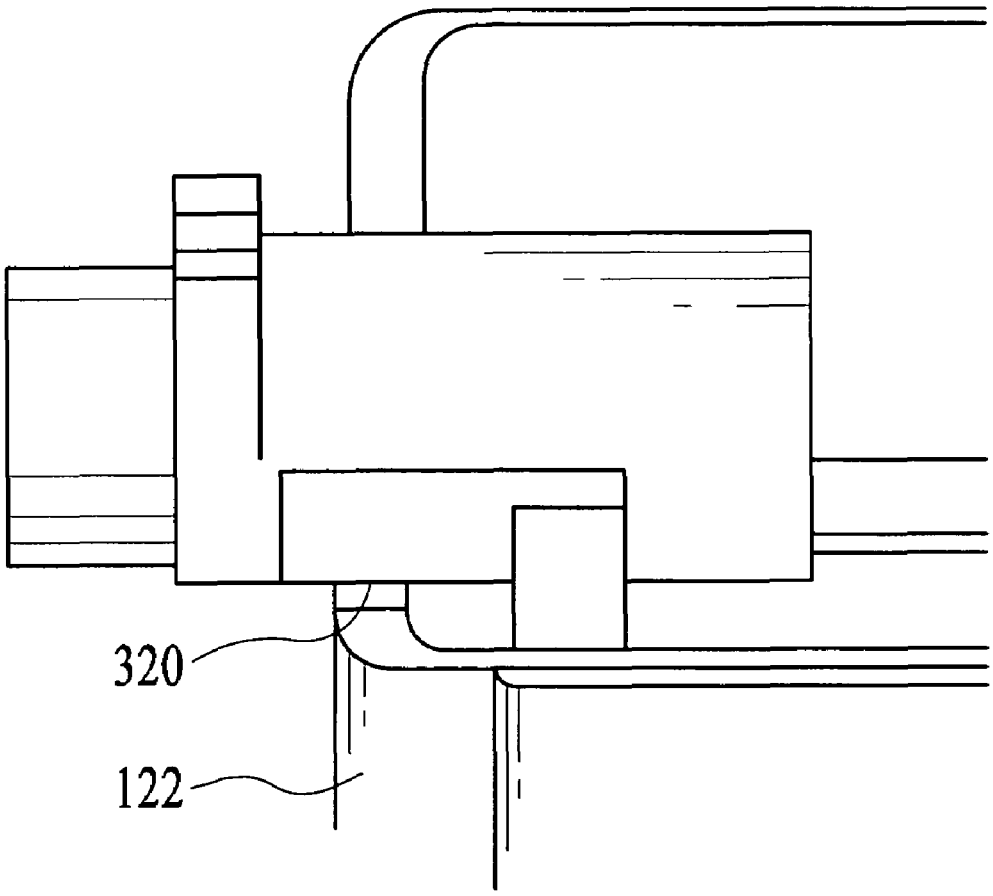
FIG. 8 a side-view diagram of the roller adjustment device of FIG. 2 in accordance with the present invention.

FIG. 8 a side-view diagram of the roller adjustment device 102 of FIG. 2 in accordance with the present invention. As is shown the roller adjustment device 102 is supported the frame support 122. In a specific embodiment, roller adjustment device 102 can be further supported on a narrow flat surface 320 to provide increased stability.

According to the system and method disclosed herein, the present invention provides numerous benefits. For example, it reduces costs because tooling the roller adjustment device is easier and keeps tighter tolerances, instead of having to keep the tolerance of multiple parts such as the document feeder device frame, shaft bearings, extension spring bearings, etc. Keeping a tight tolerance for one part is much easier and cheaper than keeping a tight tolerance for multiple parts. Due to multiple bends in document feeder device frame, it is very difficult, and very expensive, to keep a tight tolerance needed for obtaining that parallelism. The roller adjustment device simply keeps such a tight tolerance. Yet another advantage of the present invention is that it allows for additional devices such as an optical scanner to be integrated with the printer without compromising the reliability of the document feeder device.

Note that the present invention is not limited to printers and may apply to other systems and still remain within the spirit and scope of the present invention.

A document feeder device is disclosed. The document feeder device comprises a frame, a first roller shaft coupled to the frame, and a second roller shaft coupled to the frame. In a specific embodiment, the first roller shaft is a cantilevered roller shaft. The document feeder device further includes a bearing coupled to the first roller shaft. The bearing has an eccentric shape and the eccentric shape allows the bearing to be rotated such that the position of the first roller shaft stays parallel to the second roller shaft. As a result, rollers attached to the first and second roller shafts are kept aligned so that they reliably feed documents through a printer. The document feeder device decreases production costs by eliminating the need for additional frame hardware and/or more rigid frame hardware.

Although the present invention has been described in accordance with the embodiments shown, one of ordinary skill in the art will readily recognize that there could be variations to the embodiments and those variations would be within the spirit and scope of the present invention. Embodiments of the present invention can be implemented using hardware, software, a computer readable medium containing program instructions, or combination thereof. Accordingly, many modifications may be made by one of ordinary skill in the art without departing from the spirit and scope of the appended claims.

What is claimed is:

1. A document feeder device comprising:

a frame;

a first roller shaft coupled to the frame, wherein the first shaft is cantilevered;

a second roller shaft coupled to the frame; and a bearing coupled to the first roller shaft, wherein the bearing has an eccentric shape, wherein eccentric shape allows the bearing to be rotated such that the position of the first roller shaft stays parallel to a second roller shaft; and wherein the bearing comprises an attaching portion for attaching a spring, and wherein the attaching portion and the spring adjust a degree of rotation of the bearing.

2. The device of claim 1 wherein the bearing comprises a bore for receiving the first roller shaft, and wherein a diameter of the bore is offset from a diameter of the bearing to provide the eccentric shape.

3. The device of claim 1 wherein the eccentric shape allows the bearing to be rotated to adjust an amount of contact pressure between the first roller shaft and a second roller shaft.

4. The device of claim 1 wherein the spring is a torsion spring.

5. The device of claim 1 wherein the attaching portion comprises one or more teeth for attaching the spring.

6. The device of claim 5 wherein the one or more teeth and the spring adjust a degree of rotation of the bearing.

7. The device of claim 5 wherein the one or more teeth and the spring adjust an amount of contact pressure between the first roller shaft and the second roller shaft.

8. The device of claim 1 wherein the bearing comprises a supporting portion for supporting the roller adjustment device.

9. The device of claim 8 wherein the supporting portion keeps the first roller shaft aligned with the second roller shaft.

10. The device of claim 8 wherein the supporting portion keeps the first roller shaft parallel to the second roller shaft.

11. The device of claim 8 wherein the supporting portion comprises a flat surface.

12. A document feeder device comprising:

a frame;

a first roller shaft coupled to the frame, wherein the first roller shaft is cantilevered;

a second roller shaft coupled to the frame; and a bearing coupled to the first roller shaft, wherein the bearing has an eccentric shape, wherein the bearing comprises one or more teeth for attaching a spring, wherein the one or more teeth and the spring adjust a degree of rotation of the bearing, and wherein eccentric shape allows the bearing to be rotated such that the position of the first roller shaft stays parallel to a second roller shaft.

13. The device of claim 12 wherein the bearing comprises a bore for receiving the first roller shaft, and wherein a diameter of the bore is offset from a diameter of the bearing to provide the eccentric shape.

14. The device of claim 12 wherein the one or more teeth and the spring adjust an amount of contact pressure between the first roller shaft and a second roller shaft.

15. The device of claim 12 wherein the spring is a torsion spring.

16. The device of claim 12 wherein the bearing comprises a supporting portion for supporting the roller adjustment device.

17. The device of claim 16 wherein the supporting portion keeps the first roller shaft aligned with the second roller shaft.

18. The device of claim 16 wherein the supporting portion keeps the first roller shaft parallel to the second roller shaft.

19. The device of claim 16 wherein the supporting portion comprises a flat surface.

20. A document feeder device comprising:

a frame;

a first roller shaft coupled to the frame, wherein the first roller shaft is cantilevered;

a second roller shaft coupled to the frame; and a bearing coupled to the first roller shaft, wherein the bearing has an eccentric shape, wherein the bearing comprises a bore for receiving the first roller shaft, wherein a diameter of the bore is offset from a diameter of the bearing to provide the eccentric shape, wherein the bearing comprises one or more teeth for attaching a spring, wherein the one or more teeth and the spring adjust a degree of rotation of the bearing, wherein eccentric shape allows the bearing to be rotated such that the position of the first roller shaft stays parallel to a second roller shaft, and wherein the one or more teeth and the spring adjust an amount of contact pressure between the first roller shaft and a second roller shaft.

* * * * *